United States Patent [19]

Sabel

[11] Patent Number: 4,674,261

[45] Date of Patent: Jun. 23, 1987

[54] MACHINE FOR LOADING AND CLOSING A SHIPPING CASE WITH A TELESCOPIC LID

[76] Inventor: Herbert J. Sabel, 543 Avenue Del Oro, Sonoma, Calif. 95476

[21] Appl. No.: 878,265

[22] Filed: Jun. 25, 1986

[51] Int. Cl.[4] ..... B65B 5/06

[52] U.S. Cl. ..... 53/242; 53/207; 53/290; 53/564

[58] Field of Search ..... 53/242, 564, 207, 290, 53/458, 457, 462, 471, 467, 287

[56] References Cited

U.S. PATENT DOCUMENTS

| | | | |
|---|---|---|---|
| 3,332,208 | 7/1967 | Dieter et al. | 53/290 |
| 3,605,377 | 9/1971 | Sabel | 53/242 X |
| 3,817,018 | 6/1974 | Vickers | 53/462 |
| 4,150,523 | 4/1979 | Gentili | 53/207 X |
| 4,481,752 | 11/1984 | Sabel | 53/242 X |
| 4,610,125 | 9/1986 | Meives et al. | 53/207 X |

*Primary Examiner*—James F. Coan

*Attorney, Agent, or Firm*—Owen, Wickersham & Erickson

[57] ABSTRACT

An automatic machine for loading and installing a telescopic lid on a shipping case is disclosed. The machine provides for bottom loading an open-top case with product which may extend slightly above the case sidewalls when loaded therein. After the machine has loaded the case and closed its bottom flaps, a pre-scored and slotted lid member in sheet form is positioned above the case and then moved onto it as as its side and end panel members are folded against the case sidewalls and joined together to form a snug fitting telescoping lid on the case.

15 Claims, 7 Drawing Figures

MACHINE FOR LOADING AND CLOSING A SHIPPING CASE WITH A TELESCOPIC LID

This invention relates to packaging machines, and more particularly to a machine for rapidly and automatically loading stacked articles into a folded shipping case and installing a separate cover on the loaded carton.

BACKGROUND OF THE INVENTION

Various automatic machines have been developed for loading cases or corrugated cartons with different articles. In prior developments of such machines, many problems arose with the loading of products vertically into top opening cases or horizontally from one side or an end. Such problems were solved to a large degree by a method and apparatus for loading articles up into the bottom of a case, as disclosed in my earlier U.S. Pat. No. 3,605,377 and in my later U.S. Pat. No. 4,481,752. However, both of these patents cover apparatus for loading one-piece cases such as a regular slotted carton (RSC), wherein the top flaps of the carton are folded and sealed after the case is loaded. Such cases are satisfactory for use when the articles being loaded are dimensionally uniform and there is consistently ample room for bending the top flaps into their proper closing position. However, a serious problem arose in situations where a stack of articles to be loaded consistently varied in total height even though the number of articles was always the same for each case load. For example, in the shipment of paper in sheet form, the height of 1000 paper sheets might vary significantly from stack-to-stack. Thus, when it is necessary to ship such products in a case, it was impractical and inefficient to use an RSC type case. If the height of the case was sized to accommodate a selected number of paper sheets, the inherent variations in paper sheet thickness often caused some stacks to be too short or too high. If too short, an empty space was created above the paper in the case which was inefficient and also reduced the carton's ability to withstand stacking during shipment or storage without crushing. To counteract this, it was necessary to add dunnage to the empty space. If the paper stack was too high, the RSC case top flaps could not be folded and sealed properly. Accordingly, it was found to be necessary to utilize an open-top, half-slotted case (HSC) with a separate telescoping top. Moreover, it became apparent that to maximize the efficient use of case space, the open-top case was preferably sized in height so that the stack of articles being loaded would always fully occupy the carton space. This meant that in many instances the stack of articles when loaded would extend slightly above the top edge of the open-top case. The problem which then arose was to provide a machine capable of automatically installing a properly fitting top or lid to a case and more particularly to provide this lidding operation as part of a machine that performs the initial loading function.

A general object of the present invention is to provide an automatic packaging machine that solves the aforesaid problem.

More specifically, another object of the invention is to provide a packaging machine that will automatically load a stack of articles through the bottom of an open-ended shipping case, close and seal the bottom flaps of the case and then install a telescoping lid covering the loaded articles and fitting it around the upper end of the carton.

Another object of the invention is to provide an automatic packaging machine for bottom loading cases with a stack of product and installing telescoping lids to the cases in a rapid manner while providing consistently uniform folding and positioning of lid flaps and thus a snug fitting of the lid for each case despite variations in the height of product stacks being loaded therein.

Another object of the present invention is to provide an automatic packaging machine for installing a lid on a loaded, open-top case wherein the lid is provided as a scored sheet, positioned on top of the case and then is folded and glued into a telscoping configuration on the case.

Still another object of the present invention is to provide an automatic packaging machine for bottom loading a carton and installing a telescoping lid thereon that is particularly efficient and will operate at a relatively high output rate with maximum reliability and minimal maintenance.

SUMMARY OF THE INVENTION

In accordance with the present invention, an automatic packaging machine is provided which receives stacked articles to be loaded from an in-line conveyor and moves them into position to be loaded through the bottom of a half-slotted (HSC) shipping case. The case is drawn from a stack of flat, folded cases in a magazine and is erected and positioned for loading. After an article stack has been placed into the open case, the bottom flaps are automatically closed as the loaded case is moved through succeeding stations. With the bottom flaps folded and glued, the loaded case is moved to a lidding section and positioned below a foldable lid provided in sheet form. The machine lowers the lid until it contacts the top of the case or the stacked articles extending slightly above its top edge. The sides of the lid are then bent downwardly against the top side walls of the case and their end tab portions are bent around and against the top end walls of the case. The end panels of the lid are then bent downwardly against and are glued to the lid end tab portions. The result is a loaded case with a snug fitting telescoping top lid that fits properly even though the stacked articles within the case are slightly higher than its side walls. Once the lid is in place, the loaded case is moved automatically to an exit conveyor. Thus, the machine according to the present invention operates automatically without the need for human power or logic to load cases and apply telescoping covers thereto on a relatively rapid, continuous basis.

Other objects, advantages and features of the invention will become apparent from the following detailed description of one embodiment thereof presented in conjunction with the accompanying drawings.

DETAILED DESCRIPTION OF EMBODIMENT

Figure 1:
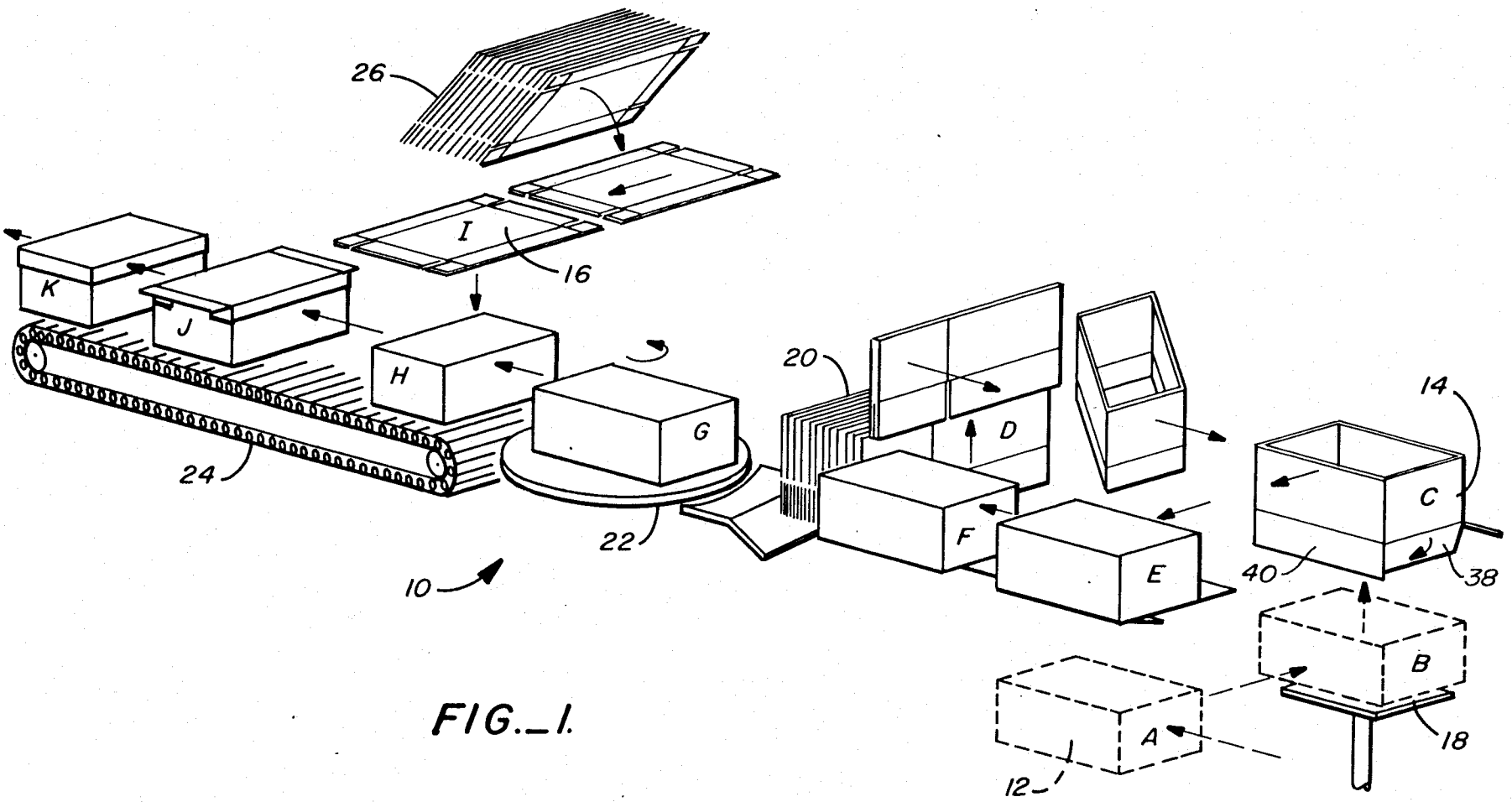
FIG. 1 is a schematic view in perspective showing the operational steps for loading and covering a shipping case in accordance with the present invention.

With reference to the drawing, FIG. 1 shows schematically the functional phases of an automatic case loading and lidding machine 10 according to the invention. More specifically, it illustrates how a stack of product 12 is bottom loaded into a case 14 which is then closed with a separate telescoping lid 16. In general, the bottom loading of the case, which has an open top and standard bottom side and end flaps, is accomplished using similar procedures and components as described in my U.S. Pat. No. 3,605,777. Here, the product 12, which, for example, may be stacks of computer paper that vary slightly in height, are supplied to the machine 10 on an input feed conveyor (not shown) at position A. Each product stack is moved in a 90° direction to position B onto an elevator platform 18 beneath a case 14 that has been positioned (at C) with its bottom flaps open. The opened case was previously drawn from a magazine 20 at position D and opened from its folded condition before reaching position C. The product stack is raised by the elevator platform into the case, and its bottom end flaps are closed. The case is then moved sideways at position E as one bottom side flap is partially closed. Then, as the case is moved to position F, both bottom major flaps are partially folded in preparation for gluing. As the loaded case is then transferred from position F to a rotary reorientation platform 22 at position G, the bottom flaps are glued. This platform rotates the loaded case 90° before the case 14 is moved to position H onto a moving conveyor 24 below a unfolded lid 16. The latter is drawn from a lid magazine 26 and then moved to a position I above the loaded case. At position H, the lid is lowered onto the loaded case and the lid side panels are folded against the case into its partially telescoping configuration. From position H, the case reaches position J where end tabs on the lid side panels are folded against the case end walls. The case then continues to move to position K where the lid end panels are glued and folded to be fully closed. From position K the loaded and lidded case exits the apparatus 10.

The apparatus 10, as shown in greater detail in FIGS. 2 to 5 is comprised generally of an integrated frame 30 of connected structural members which supports the various actuators, switches and other components that accomplish the aforesaid procedural steps from stations A through K. All of the switches and actuators are shown diagrammatically in FIG. 6 as well as in FIGS. 2 to 5 in order to illustrate certain structural details as well as operational features of the apparatus 10.

Figure 2:
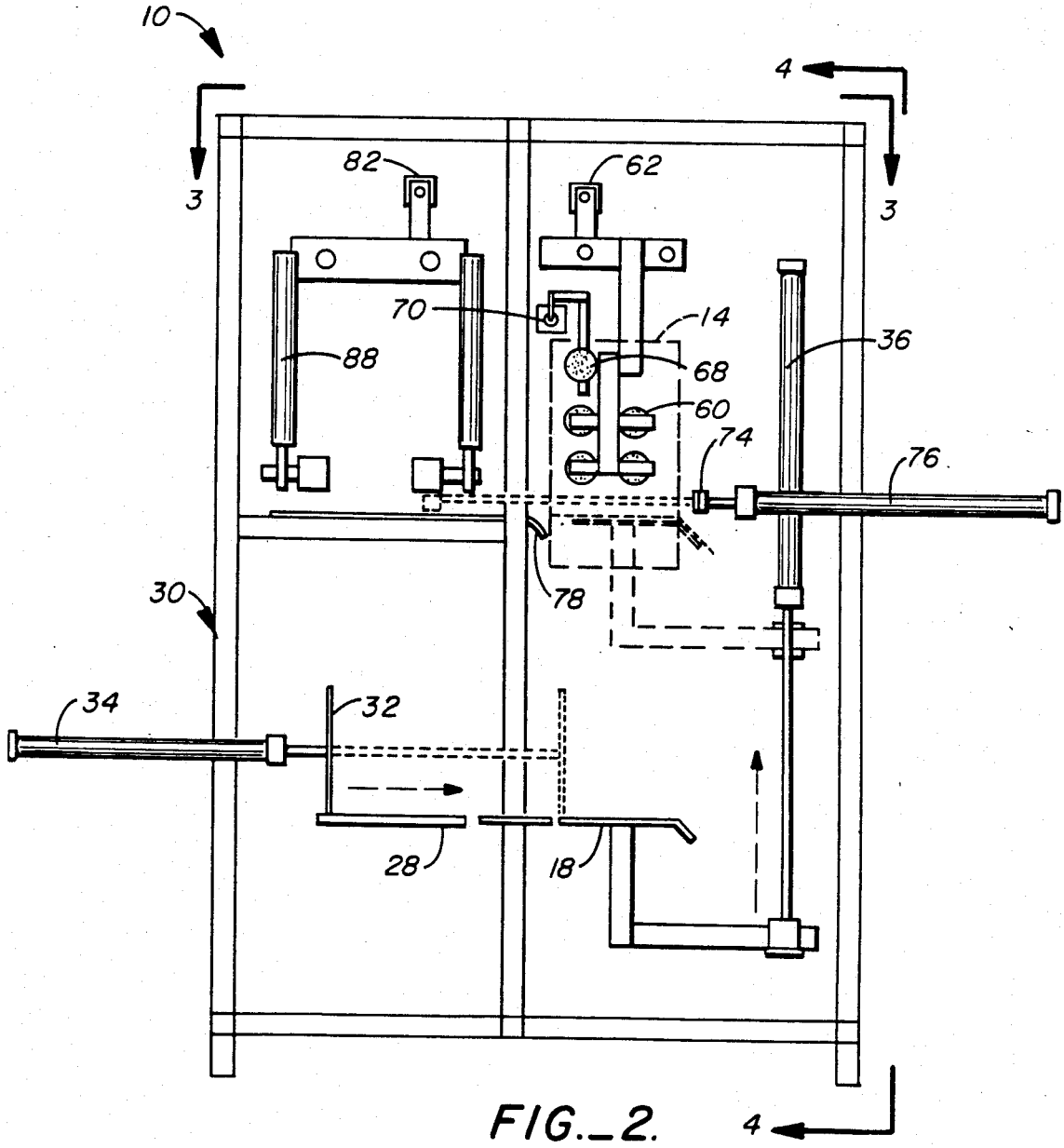
FIG. 2 is a partially schematic end view of a case loading and lidding machine embodying principles of the invention.

Turning to FIG. 2, a partially schematic end view of the apparatus 10 is shown which indicates a receiving platform 28 for the product to be loaded which is supported by a frame 30 for the machine and adapted to be connected with an input conveyor (not shown). The frame 30 comprising interconnected structural members located to support the cartons and various components of the machine, is not shown in full detail throughout the description in order to simplify the more important features thereof. As each stack of product arrives at and is positioned on the receiving platform, it is moved in a 90° direction by a vertical pusher plate 32 connected to a linear actuator 34. The stroke of this actuator is sufficient to move the product stack onto the elevator platform 18 which is essentially a rigid planar sheet. The elevator platform is connected to a vertically oriented linear actuator 36 supported by the apparatus frame. The stroke of this latter actuator is sufficient to raise the product stack upwardly through the open bottom of an erected case that is being held directly above.

Figure 3:
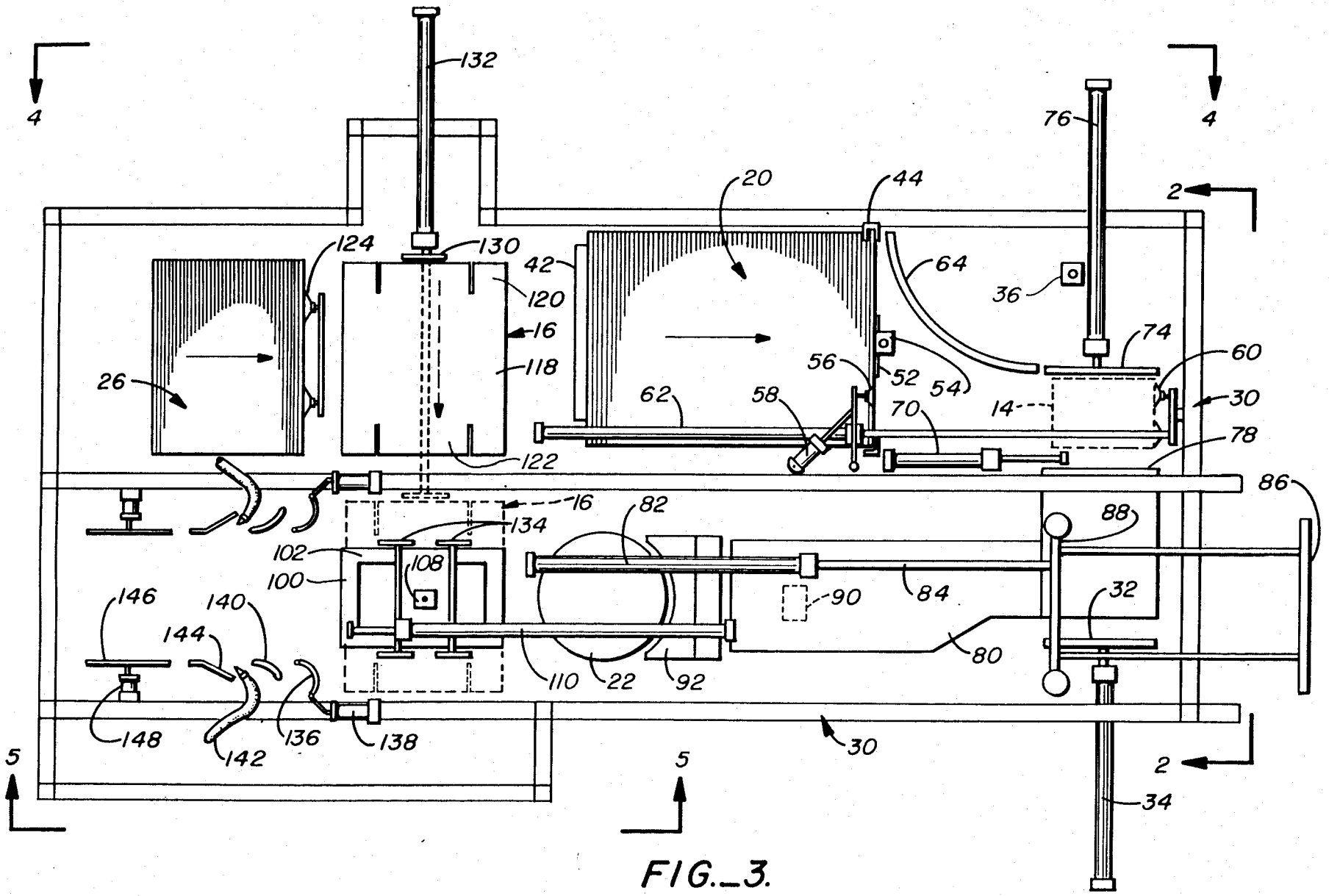
FIG. 3 is a schematic plan view in elevation of the machine of FIG. 2, taken along line 3—3 thereof.
Figure 4:
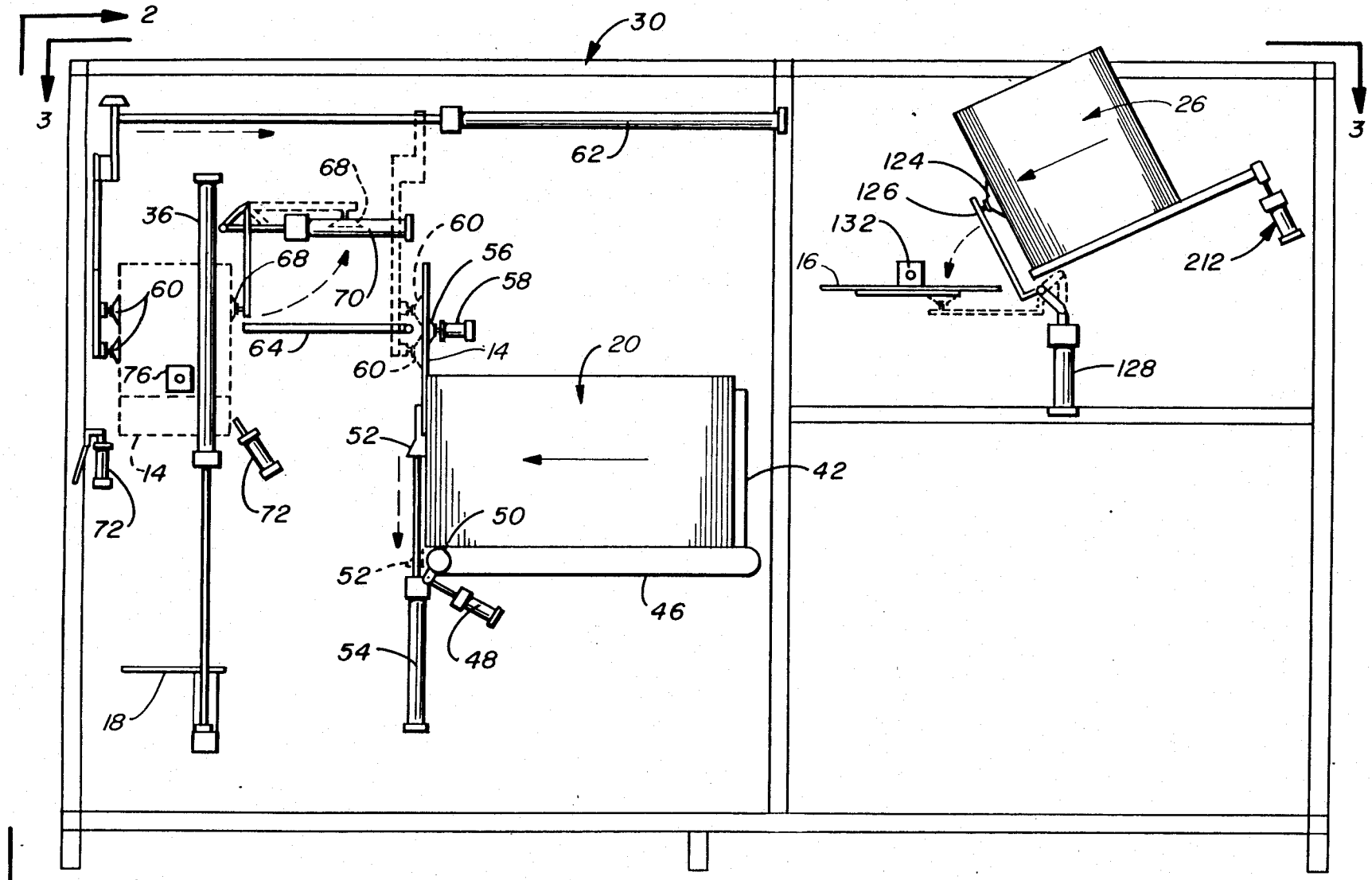
FIG. 4 is a schematic side view in elevation of the apparatus of FIG. 2, taken along line 4—4 thereof.

The cases 14 used by the apparatus 10 are of the standard type made of corrugated paper board, having bottom end (minor) and side (major) flaps 38 and 40 and with sidewalls and end walls forming an open top adapted to be closed by a telescoping lid 16. As shown in FIGS. 3 and 4, the cases are stored in a fully folded flat condition in the magazine 20 from which they must be pulled and unfolded into their partially erected position, i.e. with their side and end walls at right angles and their bottom flaps open. Within the magazine, the flat cases are stored in substantially a vertical position and are pressed by a rear pusher means 42 against a pair of guide members 44 forming stop means at the front or outlet end of the magazine. As shown in FIG. 4, the pusher means 42 is connected to a chain conveyor 46 which is advanced by an indexing actuator 48 connected to a front sprocket 50 for the conveyor. The front or outermost case being pushed against the stop means in the magazine is first stripped from the other cartons by being moved upwardly. This is accomplished by a narrow pusher member 52 attached to a linear actuator 54 which causes the front carton to be pushed upwardly so that both of its side walls are exposed.

With the front carton in its up position, a first series of rear suction cups 56 is moved by an actuator 58 to engage the rear side panel of the raised case and to adhere to it when a vacuum is applied to the suction cups from a suitable vacuum source (not shown). Also, a second pair of front suction cups 60 controlled by an actuator 62 is provided to engage and adhere to the front side panel of the raised case. The front suction cups 60 operate to pull the folded case against a curved opening rod 64 attached to the apparatus frame and this movement of the case against the rod 64 causes it to open into its erected position directly above the elevator platform. The first series of suction cups 56 also help to open the case into its erected condition as it is moved against the rod 64. As explained in greater detail below in the operation section, the first suction cups hold one side of the raised case as the second cups commence to unfold the case before it is moved against the open rod 64 by the front cups 60. After the case is moved by the front cups a predetermined distance so that erection of the case has commenced, a switch is tripped which cuts off the rear vacuum cups.

After the erected case is moved into position above the elevator 18, a third vacuum cup 68 operated by an actuator 70 is moved to engage an end panel of the erected case to stabilize during the loading operation previously described.

With product loaded within the case, the elevator platform 18 temporarily forms the bottom of the carton. At this point, a pair of actuators 72 are switched on to contact and close the carton's bottom end or minor flaps by bending them around the ends of the platform.

As shown in FIG. 3, a cross pusher 74 connected to an actuator 76 is now activated to push the loaded case off of the elevator platform toward the other side of the apparatus. As this occurs, the leading major or bottom side flap is folded under the carton by a curved plate 78 and the trailing major bottom side flap is folded outwardly away from the case. At this point, the loaded case is supported on a linearly extending main slide plate 80 which extends from a first carriage position E (FIG. 1) that is directly in line with a second carriage position F. A single actuator 82 having a linearly movable rod 84 connected to two spaced apart pushers 86 and 88 controls the movement of the case from the first carriage position to the second carriage position. A glue gun 90 is positioned underneath the main slide plate to glue the major bottom flaps of the carton as it is moved by the pusher 88 from main carriage position F to the orientator 22. The folding of the bottom flaps, after application of the glue, is completed by means of a fixed folding ramp 92 at the end of the main slide plate 80. The movement of the loaded carton through the first and second carriage positions is controlled by switches and sensors which are described below relative to FIG. 6.

As the bottom flaps are glued, the loaded case in carriage position two is moved by the second pusher 88 on the actuator 82 onto the rotatable reorientor platform 22. This platform is supported on a power driven shaft that rotates the loaded case 90° to position it for receipt of a lid 16 in the lidder section of the machine.

From the case reorientor 22, the loaded case is pushed by the next succeeding case onto the conveyor 24 comprised of a series of adjacent rotatable tubes and known as a live tubular roller conveyor. This conveyor moves the loaded case against a lidder gate 94 connected to an actuator 96 which stops the case directly beneath a lidder device 98. The latter is essentially a combined lid holder and folder means. As shown in greater detail in FIG. 5A, it comprises a pair of parallel and spaced apart channels 100 which are attached to lower ends of curved folding members 102. The upper ends of these folding members are parallel and are spaced apart by a distance only slightly greater than the outside width of the case. These folding members are interconnected by cross members 104 which are connected to the end of an arm 106 for a lidder actuator 108. Thus, when the opposite edges of an unfolded lid 16 are supported within the channels, the lid can be moved towardly by the lidder actuator to engage the top of the case or against the product within the case which extends above its top. The actuator 108 is itself connected to another actuator 110 which is positioned above and in line with the conveyor 24 so that the entire lidder device can be moved linearly. Attached to a bracket 112 on the movable rod 114 for the actuator 110 is a fixed projection 116 for engaging a series of switches as the actuator rod 114 moves the lidder device. The identification and function of these switches will be discussed below relative to FIG. 6.

The lids 16 for the cases being loaded are provided as sheets of corrugated paper board which are scored and die cut to form side panels 118 with attached end tabs 120 and end panels 122.

The scored lids in sheet form are stored in the overhead magazine 26 above and to the side of the roller conveyor 24. As seen in FIG. 4, a pair of vacuum cups 124 are attached to a movable arm 126 that is connected to a lid select actuator 128 so that it can be moved to engage an outermost lid in the magazine. From the magazine, the lid is moved to a position in line with a lid feed pusher 130 attached to an actuator 132 which pushes the lid into the holder channels 100 of the lidder device 98. The switches and sensors required for this operation will also be described below in greater detail with reference to FIG. 6.

Figure 5:
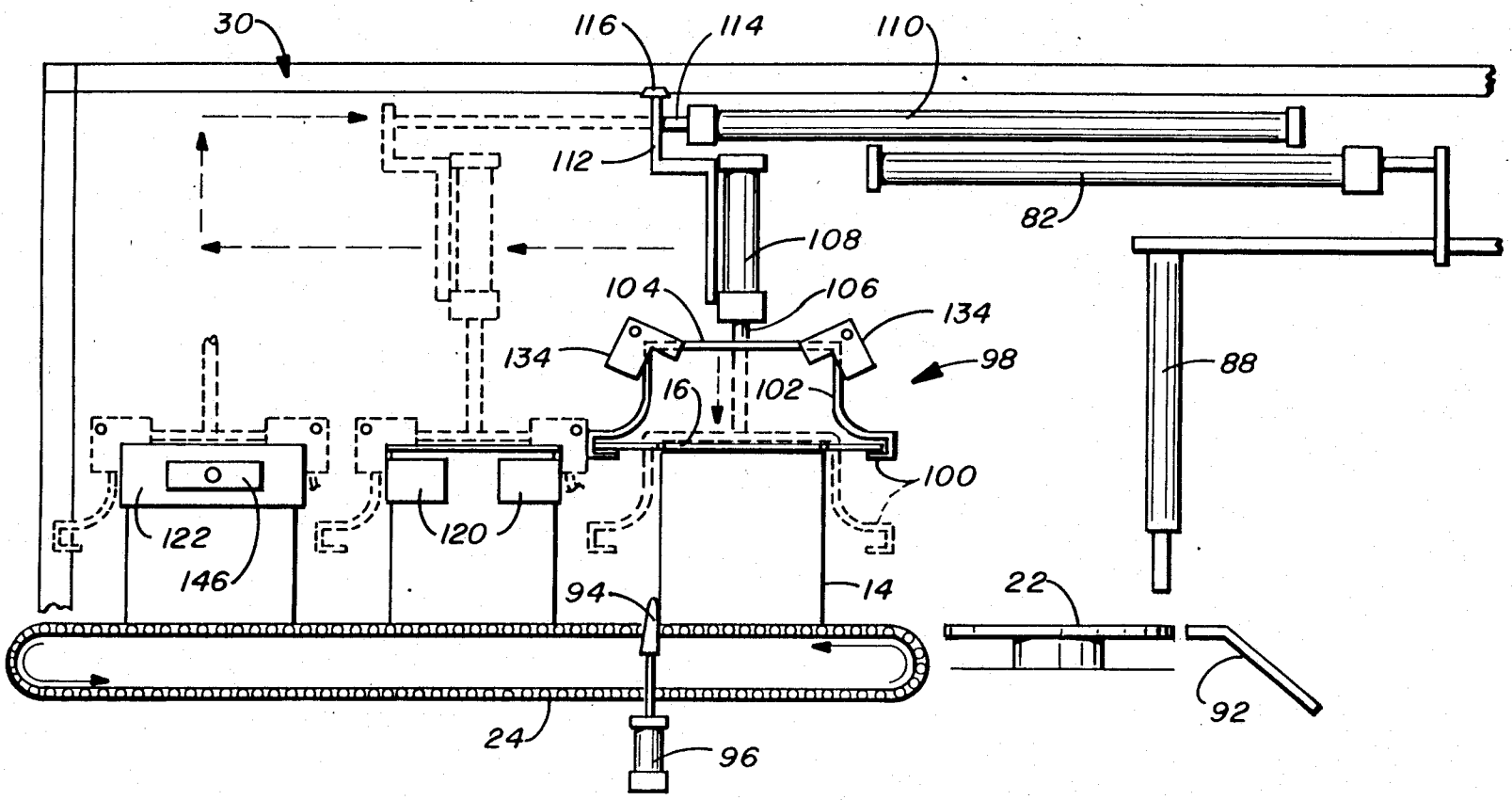
FIG. 5 is a fragmentary schematic view in elevation showing the lidding section of the apparatus of FIG. 2, taken along line 5—5 thereof.
Figure 5A:
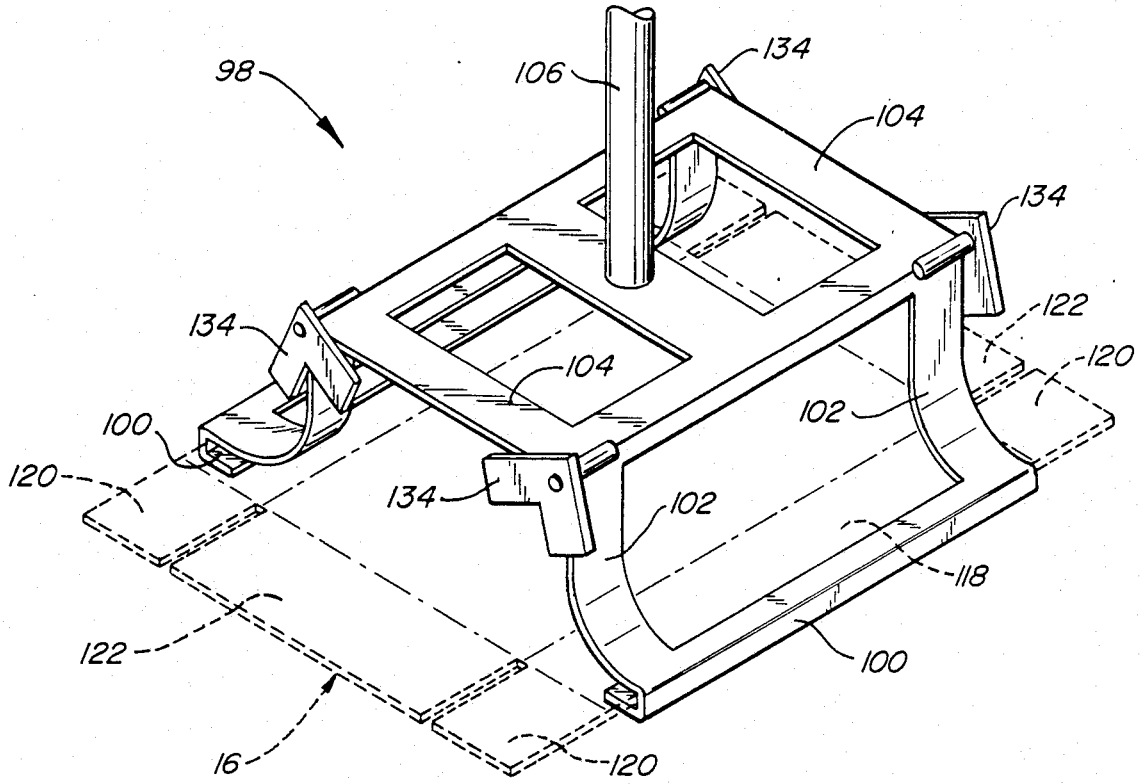
FIG. 5A is a fragmentary view in perspective showing a portion of the lidding section for the apparatus of FIG. 2.

Pivotally mounted on the lidder device near the ends of its cross members 104 are a series of L-shaped side panel retainers 134. After the loaded case is moved onto the roller conveyor 24 and is retained by the lidder gate 94, the actuator 108 for the lidder device 98 is activated and moves the lid being held by the channels downwardly. As soon as the lid engages the top of the case or the product therein extending above the top, the side panels 118 of the lid are bent downwardly. As the lidder device continues its downward stroke, the curved portions of the folding members 102 push the side panels of the lid closer against the adjacent sides of the case. When the lidder device reaches its full bottom position, the L-shaped retainers 134 are rotated into position to hold the lid side panels firmly against the case side walls as shown in FIG. 5. The gate 94 is now retracted, and the loaded case with the lid side walls held against its sides by the lidder device, is moved along the conveyor 24 by the actuator 110.

As the loaded case moves further it passes through a pair of movable folding bars 136, each controlled by an actuator 138 which fold the tabs of the lid and hold them in position against the ends of the case. A pair of folding bars 140 attached to the frame are positioned to engage and close the leading lid tabs as the case continues to move along the conveyor.

Now, with the lid side panels and the end tabs thereon folded into position, as shown in FIG. 5, a pair of glue guns 142 (FIG. 3) at opposite ends of the case are positioned to apply glue to the tabs.

As the loaded case continues to move in the lidder section of the machine, the minor or end panels of the lid are first bent downward partially by a pair of deflection bars 144 located on opposite sides of the roller conveyor. With glue having been applied to the end tabs, the lid end panels 122 are pushed firmly against the end tabs 120 by a pair of compression plates 146 located on opposite sides of the roller conveyor, each plate being connected to a separate actuator 148. The lidder device 98 then moves upwardly by means of actuator 108 and then horizontally by means of actuator 110 until the lidder device 98 is back in its home position. After a preset time period, the compression plates are retracted and the loaded case with its telescoping lid in place is removed from the machine by the conveyor 24.

Having described the essential components of the apparatus 10, its operation with respect to the various switches, sensors and actuators will be described in detail with reference to FIG. 6. The timing, sequencing and other control aspects of the various switches and actuators is program controlled by a suitable processor such as Texas Instruments Programmable Controller which is programmed in a conventional manner to produce the desired sequencing and time of the various actuators utilizing known state-of-the-art procedures.

Figure 6:
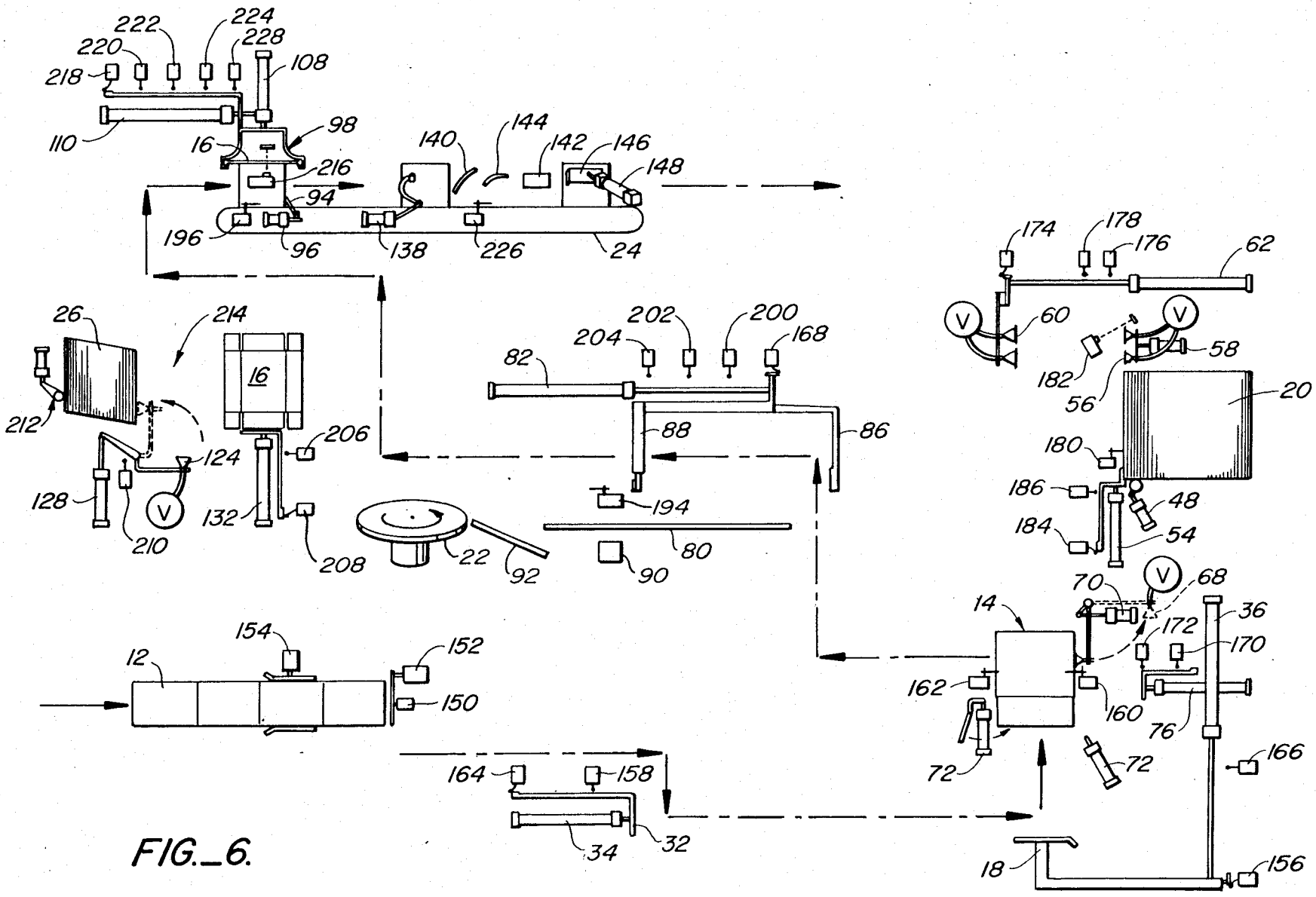
FIG. 6 is a diagrammatic view of the case loading machine according to the invention illustrating the various actuating, indexing, sensing and switching devices that provide its automatic operation.

On FIG. 6, which is a diagrammatic flow chart for the operation of machine 10, all limit switches such as micro-switches and sensors such as photocells that provide information on the machine to determine positioning, etc. are designated diagrammatically as well as the working components on the machine (e.g. air cylinders, clutch/brakes, indexers). The term "home position" refers to the deactuated condition of each component as it would occur at the beginning of the machine cycle.

Now, referring to FIG. 6, when product such as stacks 12 of computer paper is supplied via an infeed conveyor, an infeed trip switch 150 detects that a product stack has reached a retracting trip switch 152. This causes a product stop 154 to close and stop the flow of incoming product. This product stop initiates a time delay controlled by a central processor (not shown) which when timed out actuates the retracting trip switch 152. The latter initiates a time delay which when timed out provides a signal to be used with the infeed trip switch 150 and a switch 156 to actuate the product push-over 32. Switch 156 indicates that the elevator 28 is down and in position to accept product. The product push-over 32 actuates, transferring the product to the elevator platform 18, in position below the opened case. A switch 158 indicates that the product push-over assembly has reached full stroke and that the product has reached the elevator. A pair of position switches 160 and 162 indicates that a case has been fully opened and is in position above the loading chamber. The elevator 18 is actuated, lifting product into the opened case.

Actuation of the elevator by moving off switch 156 causes the product push-over 32 to retract, and a position switch 164 on the actuator 34 indicates that it is fully retracted thereby causing the product stop 154 to reopen. The product stop opening causes the retracting trip 152 to reset, and the machine is now prepared to accept the next product. A switch 166 indicates that the elevator has reached its full stroke and that product has been loaded into the opened case. Activation of the switch 166 also causes the bottom flap folders 72 to actuate and fold the bottom minor case flaps. The bottom flap folders initiate a time delay which when timed out provides a signal to be used with a switch 168 to actuate the case cross push 76. A switch 168 on the main carriage indicates that the main carriage actuator 82 is in the home position and prepared to accept the case and product. The case cross push 76 actuates and transfers the case and product to the main carriage area. A switch 170 indicates that the case cross push has reached mid-stroke and also causes the bottom flap folders 72 to retract to their home positions.

A switch 172 indicates that the case cross push 76 has reached its full stroke and causes the elevator to return to its home position. The switch 172 also causes the case cross push 76 to return to its home position.

A position switch 174 indicates that the front case open actuator 62 is in the home position, and another switch 176 indicates that the front case open has been actuated and has reached its full stroke. In between in another switch 178 which cuts off the vacuum to the rear case cups 56 after the front cups 60 have opened the case part way. When switches 174 and 176 are made in the proper sequence, they provide a signal to be used with a pair of switches 180 and 182 to actuate the case strip-off actuator 54. The switch 180 indicates a flat case is in position to be stripped off and the switch 182 controlled by a photo-cell indicates that the path is clear for a flat case to be stripped off. The case strip-off actuator 54 actuates and transfers a flat case from the front of the case magazine upwardly to the stripped case position. As the case strip-off actuates moves, it leaves its home switch 184 thereby providing a signal for the rear case vacuum cup actuator 58 to actuate, thereby retracting the rear case open or first series of cups 56 and clearing the path for a flat case to be stripped off. As the strip-off 54 reaches its full stroke position, a switch 186 is made which provides a signal for the rear case open actuator 58 to return to its home position. The switch 186 also provides a signal for the rear case vacuum cups 56 to turn on their valve to a vacuum source designated as "V" in FIG. 6. The combination of switch 186 and vacuum turn-on of valve initiates a time delay which when timed out, provides a signal that causes the case strip off actuator 54 to return to its home position.

As the case cross push 76 actuates, the switch 170 is made at mid-stroke. This signal along with photo-eye 182 provide signals which actuate the front case open actuator 62. The photo-eye 182 shows that a case exists in the stripped case position and is prepared to be opened. When the front case open actuator reaches its full retracted position, the switch 176 is made and provides a signal which initiates a time delay which, when timed out, causes the front case open actuator to return to its home position. The switch 176 also provides the signal which turns on the front case vacuum valve for the second cups 60. During the next case loading cycle, the bottom flap folders 72 actuate and a signal is provided which causes this front case vacuum valve to turn off, thereby releasing the loaded case for the cross push.

As the case strip-off actuator 54 moves, the switch 186 is made at full stroke. This actuator then returns to its home position and the switch 184 is made. The switches 184 and 186 in sequence initiate a reciprocating cycle which will cause the case magazine index actuator 48 to move and return to its home position five times or until a case sensor switch 180 at the front of the magazine to be is made.

As the case cross push 76 is actuated, a signal is provided which causes the hold-down vacuum cup actuator 70 to actuate, retracting the cup 68 to clear the path for the next case to be opened. When the case reaches the fully opened position and is prepared for loading, the position switches 160 and 162 will be made. These two switches provide the signal for the hold-down vacuum cup 68 to return to its home position. As the bottom flap folders 72 actuate, the hold-down vacuum is turned off, releasing the loaded case from cup 60 and 68 for a cross push. As the front case open actuator 62 moves, the hold-down vacuum is turned back on in preparation for the next case.

The case has now been opened, loaded with product and its bottom minor flaps have been folded. The case and product are then transferred to the main carriage area or slide plate 80 by means of the case cross push 76. When the case cross push 76 reaches its full stroke, the switch 172 is made, and the signal from it in combination with signals from a switch 196 and the lidder gate 94 (indicating that the path is clear in the lidder section) cause the main carriage actuator 82 to move and transfer the case to the main carriage position #2. As the first carriage stage pusher 86 transfers a case from main carriage position #1 to main carriage position #2, it actuates a glue interlock 194 for the glue dispenser 90. Just before the second pusher 88 transfers that same case from the main carriage position #2 to the case reorientor 22, while passing over slide plate 80, the glue dispenser 90 is activated. Each time the main carriage is actuated, two cases with product are transferred to their respective positions.

As the case is transferred from main carriage position #1 to main carriage position #2, the outside bottom major flap is allowed to open slightly so that it may pass under the case glue dispenser head 90. The inside bottom major flap is folded under the case to a position symmetrical with that of the outside bottom major flap. As the case is transferred from the main carriage position #2 to the case reorientor station, the case and product pass through the case glue dispenser area. A switch 200 is made during the main carriage 82 mid-stroke and the signal from this switch causes the case glue dispenser 90 to actuate, applying the first glue pattern to the bottom flaps and remaining actuated as long as switch 200 is closed. As the case continues through the gluing area, the next switch made by the main carriage during mid-stroke is 202. The signal from this switch causes the case glue dispenser 90 to actuate again, applying the second glue pattern to the bottom flaps, and the dispenser remains on as long as switch 202 is closed. For both the first and second glue patterns, the interlock switch 194 must also be made while applying glue to insure that a case is present.

During the second stage of the main carriage push, switches 200 and 194 will be made simultaneously. This condition provides a signal to be used in combination with a switch 204 to cause the case reorientor 22 to actuate. The signal from switches 200 and 194 indicates that the case is approaching the case reorientor. The switch 204 also indicates that the main carriage has reaches full stroke and that the approaching case has now been placed at the case reorientor station. The folding of the bottom major flaps is completed just before the case is placed at the case reorientor by means of the fixed folding ramp 92.

When actuated, the case reorientor rotates the case and product 90° in preparation for entering the lidder area of the machine. As the main carriage reaches its home position, the switch 168 provides the signal for the case reorientor indexing mechanism to reset, preparing for the next case. The next time the main carriage actuates, the case and product at the case reorientor will be forced into the lidder area by the following case as it is placed on the case reorientor by the second stage main carriage pusher.

A switch 208 indicates that the lid feed actuator 132 is in its home position, and a switch 206 indicates that the lid feed actuator has been actuated and has reached full stroke. When switches 206 and 208 are made in the proper sequence, they provide a signal which is used to actuate the lid select actuator 128. As the lid select component 128 actuates, it provides a signal which is used to turn on the lid select vacuum for the suction cups 124. As the lid select suction cups reach the lid magazine, a switch 210 initiates a time delay which when timed out, provides the signal to return the lid select actuator to its home position. The same signal from switch 210 initiates a second time delay which when timed out, provides a signal to turn off the lid select vacuum. The switch 210 is also used to actuate the lid magazine index 212. Each time the lid select actuator suction cups approach the lid magazine, the switch 210 is made causing a lid magazine indexer similar to the case indexer 48 to actuate and cause the lids to shift towards the front of the lid magazine.

As a lid is pulled from the lid magazine, the lid feed actuator 132 is activated and in the full stroke position waiting to receive a lid. After the lid has been placed in a lid feed assembly 214, the lid select vacuum to the cups 124 is turned off. This provides a signal which is used in combination with another switch 216 to cause the lid feed to return to its home position and transfer the lid to the lid folder station. The switch 216 is located within the lidder device 98 to indicate that it is empty and prepared to receive a new lid.

When a case with product, having its bottom case flaps folded and glued, has been rotated 90° by the case reorientor, it is then pushed off of the case reorientor 22 by the following case with product and is transferred to the live tubular roller conveyor 24 which supports the case through the lidder section. The case is conveyed to the lidder gate 94 which, when closed in its home position, will hold the case in position so that the lid folder or lidder device 98 can place the lid on the case. As the case reaches the lidder gate 94, the switch 196 is made. The signal from this switch initiates a time delay which when timed out indicates that the case has come to rest against the lidder gate 94. As the lid feed reaches its home position, the switch 206 on the lid feeder is made, and this switch initiates a timer which when timed out indicates that the lid has come to rest in the lid folder. These two signals in combination with a switch 218, 216 and the lidder gate 94 cause the lid folder 98 to lower, placing the flat lid on the case and folding the major lid flaps or panels around the case and product. The switch 218 indicates that the lidder carriage is in its home position. The switch 216 indicates that a lid is in place above the case. The signal from the lidder gate 94 indicates that the gate is closed, thereby holding the case in place. As the lid folder actuates, it initiates a time delay which when timed out indicates that the lid folder has had sufficient time to reach its full stroke. This signal is used to actuate the lid feed actuator 132 which returns to pick up a new lid and is also used to actuate the lidder gate 94, thereby causing the gate to open. As the lidder gate opens, it provides a signal which is used to actuate the lidder carriage actuator 110. When this occurs, the case with product, the partially folded lid and the lid folder assembly 98 all will be conveyed through the remainder of the lid folding section as well as the lid gluing and lid panel compression sections.

The case with product and lid begin to travel through the lidder section as the lidder carriage 110 actuates. With the major lid flaps already folded by the lid folder 98, the lid now passes through the fixed folding bars 140 which fold the leading lid tabs of the lid side panels and hold them in position. A switch 220 is the first mid-stroke switch to be made which provides the signal for the tab folder actuator 138 which fold the trailing lid tabs as the case passes by.

After the lid tabs have been folded, the minor lid panels are partially folded by the fixed folding bars 144 as they enter the lid gluing area. A switch 222 is the second mid-stroke switch to be made as the lidder carriage 110 actuates. The signal from 222 causes the lid glue dispensers 142 to actuate, applying the first glue pattern to the leading tabs. As long as the switch 222 is made, the lid glue dispensers remain actuated. A switch 224 is the third mid-stroke switch to be made as the lidder carriage actuates and its signal causes the lid glue dispenser to actuate again, applying the second glue pattern to the trailing lid tabs. As long as switch 224 is made, the lid glue dispenser remains actuated. For both the first and second glue patterns, a switch 226 must be made while applying glue to insure that a case is present.

As the lidder actuator 110 continues to move, it provides a signal which causes the lid compression plates 146 to actuate and open in preparation for the next case and lid. A switch 228 indicates that the lidder carriage has reached its full stroke. This signal is used to actuate the compression plates 146 which complete the folding of the minor lid flaps by holding them in position as the glue sets. Actuation of the lid compression plates provides a signal used in combination with switch 228 to initiate a time delay which when timed out indicates that the lid compression plates have had sufficient time to fully actuate. The signal is used to return the lid folder 98 to its home position, and also used to return the lidder gate 94 to its home position, thereby closing the gate in preparation for the next case. Also, as the switch 228 is made, it provides the signal used to return the tab folder 138 to its home position. Further, as the lid folder 98 deactuates, it initiates a time delay which when timed out indicates that it has returned to its home position and this signal is used to deactuate the lidder carriage actuator 110.

As described the invention provides a completely automatic case loading and closing machine which will load product of slightly varying height and yet provide for the efficient installation of a telescoping lid which fits the case with precision and uniformity.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A machine for automatically loading shipping cases through the bottom and installing a telescoping lid to the top thereof, comprising:

means for holding a shipping cases to be loaded in an upright position with its bottom panels open and extended downwardly;

elevator means providing a horizontal platform member located directly below said cases to be loaded;

means for moving the product to be loaded onto said platform member;

means for moving the product on said platform member vertically upward into said case;

means responsive to the positioning of said platform member at the normal bottom level of said case for closing the case bottom end panels around said platform member;

means for pushing the loaded case laterally in a first direction off of said platform member with its bottom end panels still in the closed position;

means for pushing the loaded case in a second direction which is 90° from said first direction;

means for closing the bottom side panels of the case over the bottom end panels as the case is being pushed in said second direction;

a conveyor means for supporting a loaded case;

means for moving the loaded case into said conveyor means;

lidder means for retaining a blank, unfolded lid member having side panels with bendable end tab portions and end panels, and for positioning the lid above a loaded case on said conveyor means;

means for moving the positioned lid downwardly against the upper open end of the loaded case including means for bending said lid side panels downwardly against the outside sidewalls;

means for bending said end tab portions against the outside end walls of the loaded case;

means for bending said lid end panels against and for securing them to said side panel end tab portions adjacent the outside end walls of the loaded case; and means for moving said lidder means laterally above said conveyor means and parallel to it as the lid is installed on a loaded case.

2. The machine as described in claim 1 including a rotary case orientator for receiving a loaded case after its bottom flaps have been closed and for turning the loaded case 90° before the case is moved onto said conveyor means.

3. The machine as described in claim 1 including a controllable stop means on said conveyor means for positioning a loaded case directly below said lidder means and means for releasing said stop means after a lid has been moved against the top of the case and said lid side panels have been bent downwardly against the sides of the case.

4. The machine as described in claim 1 wherein said means for bending said end tab portions comprises power actuator means and fixed folding bars located on opposite sides of said conveyor means and spaced downstream from said conveyor means.

5. The machine as described in claim 1 wherein said means for bending said lid end panels against the ends of the loaded case comprise a pair of power actuated pusher means located on opposite sides of said conveyor means.

6. The machine as described in claim 1 wherein said means for moving said lidder means laterally is a linear actuator.

7. The machine as described in claim 6 including switch means controlled by movement of said linear actuator for said lidder means for controlling said means for bending said lid end tab portions and said lid end panels.

8. For use with a packaging machine wherein a shipping case having an open upper end is loaded through its bottom end before its bottom panels are closed and sealed, a mechanism for automatically installing a telescoping cover on the loaded case, said mechanism comprising:

means for positioning a blank, planar unfolded cover member, which is scored and slotted to form side panels with bendable end portions and end panels, above a loaded open case;

means for lowering said positioned cover member downwardly to engage the upper end of the loaded case or the product therein;

means for moving said cover installing mechanism horizontally as the loaded case is moved horizontally at the same rate;

means for bending said cover side panels downwardly against the case sidewalls and for bending said end portions against the case end walls;

means for bending said cover end panels against said bent end portions adjacent the case end walls, and means for bonding said cover end panels to said bent end portions to maintain them in position and thereby form a telescoping cover on the upper end of the loaded case as it continues to move horizontally.

9. An automatic lidder device for a shipping case having an open rectangular shaped top, said device comprising:

a conveyor means for receiving and supporting said case after it has been loaded with product;

holder means above said conveyor means for retaining a lid in sheet form adapted for installation on said open, loaded carton, said lid being scored and cut to define a central area with side panels having end tabs and end panels;

stop means on said conveyor means for temporarily retaining said loaded case directly under the lid in said holder means;

side folder arms on said holder means for bending said lid side panels when said holder means is moved downwardly against the loaded case;

vertically movable actuator means connected to said folder means for lowering said lid to the top of said case and bending said lid side panel against the sides thereof;

means for moving said side panel end tabs of said lid against the ends of the case;

means for applying glue to said end tabs; and means for bending said end panels downwardly and for holding them against said glued end tabs and thereby hold said lid in a telescoping configuration on said case; and means for moving said lid holder means and thus a loaded case retained by said holder means along said conveyor means after the lid has been lowered onto said case and its side panels are folded.

10. The lidder device as described in claim 9 wherein said conveyor means comprises a series of freely rotatable cylinders, said cylinders being parallel and connected to endless belt means.

11. The lidder device as described in claim 9 including a plurality of L-shaped retainer members pivotally attached to said holder means for retaining the lid side panels tightly against the sides of the case as said end tabs are folded in place and glued.

12. The lidder device as described in claim 9 wherein said folder arms are in pairs and have upper portions which are substantially parallel and spaced apart and are connected by cross members, and integral lower portions on said folder arms which curve outwardly and away from each other, and channel-shaped members fixed to the lower outer ends of said folder arms for retaining the edges of a lid on the opposite sides of said holder means.

13. The lidder device as described in claim 9 in a magazine for retaining a plurality of said lids in sheet form and means for removing a single lid from said magazine and means for moving the removed lid into said lid holder means.

14. The lidder device as described in claim 9 wherein said means for moving said side panel end tabs against the ends of a loaded case comprise a pair of power actuated folding rods and a pair of fixed folding means positioned on opposite side of said conveyor means, said power actuated folding rods being activated after said stop means has been retracted and said loaded case has been moved along said conveyor.

15. The lidder device as described in claim 14 wherein said means for bending said lid end panels against the ends of the loaded case comprise a pair of power actuated pusher plates which are times to be activated after said side panel end tabs have been bent and glued as the loaded case is moved along said conveyor by said holder means.

* * * * *